US011539128B2

(12) United States Patent
Wilde et al.

(10) Patent No.: US 11,539,128 B2
(45) Date of Patent: Dec. 27, 2022

(54) OFFSET ANTENNA

(71) Applicant: AvL Technologies, Inc., Asheville, NC (US)

(72) Inventors: Mike Wilde, Arden, NC (US); Alan Eugene Ellis, Candler, NC (US)

(73) Assignee: AvL Technologies, Inc., Asheville, NC (US)

( * ) Notice: Subject to any disclaimer, the term of this patent is extended or adjusted under 35 U.S.C. 154(b) by 0 days.

(21) Appl. No.: 17/068,308

(22) Filed: Oct. 12, 2020

(65) Prior Publication Data

US 2021/0028541 A1 Jan. 28, 2021

Related U.S. Application Data

(63) Continuation-in-part of application No. 16/351,265, filed on Mar. 12, 2019, now Pat. No. 10,804,614.

(60) Provisional application No. 62/641,586, filed on Mar. 12, 2018.

(51) Int. Cl.

| | |
|---|---|
| ***H01Q 3/16*** | (2006.01) |
| ***H01Q 1/18*** | (2006.01) |
| ***H01Q 1/12*** | (2006.01) |
| ***H01Q 15/16*** | (2006.01) |

(52) U.S. Cl.

CPC ..... *H01Q 3/16* (2013.01); *H01Q 1/1235* (2013.01); *H01Q 1/18* (2013.01)

(58) Field of Classification Search

CPC ..... H01Q 15/162; H01Q 1/288; H01Q 1/161; H01Q 15/16; H01Q 15/161; H01Q 15/20; H01Q 15/16161; G01S 1/104; H01L 31/052; H01L 31/042; H01L 31/0525; H01L 31/0422; H02S 40/00

See application file for complete search history.

(56) References Cited

U.S. PATENT DOCUMENTS

| | | | | |
|---|---|---|---|---|
| 4,862,190 | A * | 8/1989 | Palmer | H01Q 15/20 343/915 |
| 5,198,832 | A * | 3/1993 | Higgins | H01Q 15/162 343/915 |
| 2012/0326921 | A1* | 12/2012 | Geen | H01Q 15/162 342/352 |
| 2014/0152492 | A1* | 6/2014 | Zimmerman | H01Q 1/08 29/601 |

* cited by examiner

*Primary Examiner* — Wei (Victor) Y Chan
(74) *Attorney, Agent, or Firm* — The Van Winkle Law Firm; William G. Needy

(57) ABSTRACT

A 2.2M offset antenna includes a reflector hub; a positioner for supporting the reflector hub; a plurality of reflector panels including a first plurality of side panels and a second plurality of side panels, the first plurality of side panels and the second plurality of side panels each being selectively securable to the reflector hub; each side panel of the first plurality of side panels being uniquely sized relative to the other side panels of the first plurality of side panels such that the first plurality of side panels may be nested together in a stacked configuration when separated from reflector hub; and each side panel of the second plurality of side panels being uniquely sized relative to the other side panels of the second plurality of side panels such that the second plurality of side panels may be nested together in a stacked configuration when separated from reflector hub.

20 Claims, 11 Drawing Sheets

OFFSET ANTENNA

RELATED APPLICATION

The present application is a Continuation-in-part Application of U.S. Nonprovisional patent application Ser. No. 16/351,265 filed Mar. 12, 2019, which claims the benefit of U.S. Provisional Patent Application Ser. No. 62/641,586 filed on Mar. 12, 2018, and is incorporated herein in its entirety.

FIELD OF THE INVENTION

This invention relates to a space frame antenna and, more specifically, a 2.2M portable antenna with nesting panels.

BACKGROUND OF THE INVENTION

Space frame antennas are lightweight, portable and versatile for geostationary satellite acquisition and peaking required for a specific use. Typically, a space frame antenna has a dish-type reflector and a positioner that is steerable while supporting the reflector. Traditional designs in the 2.0 and 2.2M class antennas are bulky and cannot be packed very efficiently. In the satellite industry to date, the high packability of a 2.0-2.2M class of space frame antenna has been somewhat achieved utilizing an inflatable ball and a prime focus feed mounted on the exterior of the ball. While this inflatable approach is useful for its intended purpose, there still exists considerable drawbacks relating to the high-volume storage needs for transporting the antenna and associated parts.

There exists a need in the art for a space frame antenna including a highly packable parabolic reflector and a collapsible positioner that is both space efficient and weight efficient.

SUMMARY OF THE INVENTION

In accordance with one form of the present invention, there is provided a 2.2M offset antenna including a reflector hub; a positioner that is sized and configured for supporting the reflector hub; a plurality of reflector panels including a first plurality of side panels and a second plurality of side panels, the first plurality of side panels and the second plurality of side panels each being selectively securable to the reflector hub; each side panel of the first plurality of side panels being uniquely sized relative to the other side panels of the first plurality of side panels such that the first plurality of side panels may be nested together in a stacked configuration when separated from reflector hub; and each side panel of the second plurality of side panels being uniquely sized relative to the other side panels of the second plurality of side panels such that the second plurality of side panels may be nested together in a stacked configuration when separated from reflector hub.

In accordance with another form of the present invention, there is provided an apparatus including a reflector hub; a positioner that is sized and configured for supporting the reflector hub; a plurality of reflector panels including a first plurality of side panels and a second plurality of side panels, the first plurality of side panels and the second plurality of side panels each being selectively securable to the reflector hub; each side panel of the first plurality of side panels being uniquely sized relative to the other side panels of the first plurality of side panels such that the first plurality of side panels may be at least partially nested together in a stacked configuration when separated from reflector hub; and each side panel of the second plurality of side panels being uniquely sized relative to the other side panels of the second plurality of side panels such that the second plurality of side panels may be at least partially nested together in a stacked configuration when separated from reflector hub.

In accordance with another form of the present invention, there is provided an apparatus including a reflector hub; a positioner that is sized and configured for supporting the reflector hub; a plurality of reflector panels including a first plurality of side panels and a second plurality of side panels, the first plurality of side panels and the second plurality of side panels each being selectively securable to the reflector hub; each side panel of the first plurality of side panels being progressively smaller relative to the other side panels of the first plurality of side panels such that the first plurality of side panels may be nested together in a stacked configuration when separated from reflector hub; and each side panel of the second plurality of side panels being progressively smaller relative to the other side panels of the second plurality of side panels such that the second plurality of side panels may be nested together in a stacked configuration when separated from reflector hub.

BRIEF DESCRIPTION OF THE DRAWINGS

For a fuller understanding of the nature of the present invention, reference should be made to the following detailed description, taken in conjunction with the accompanying drawings in which.

Like reference numerals refer to like parts throughout the several views of the drawings.

DETAILED DESCRIPTION

Referring to the several views of the drawings, a space frame antenna including a symmetric parabolic reflector with two different sized reflector panels which are joined in a bi-chordal and bi-radial (BCBR) configuration and a foldable positioner with fine azimuth adjustment is shown. Also shown is an embodiment based on 2.2M offset optics including progressively smaller panels that allows the side panels to be nested together.

Figure 1:
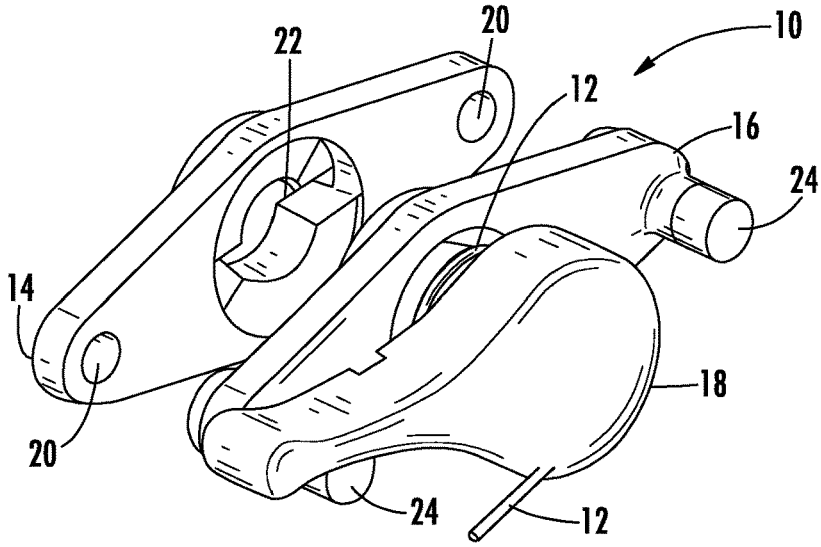
FIG. 1 is a perspective view of a machined aluminum version of a helical cam latching device.
Figure 2A:
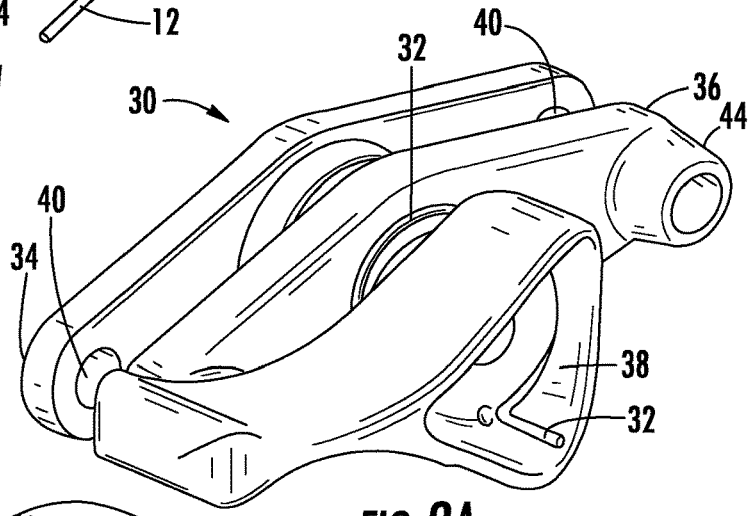
FIG. 2A is a front elevational of an injection molded embodiment of the helical cam latching device.
Figure 2B:
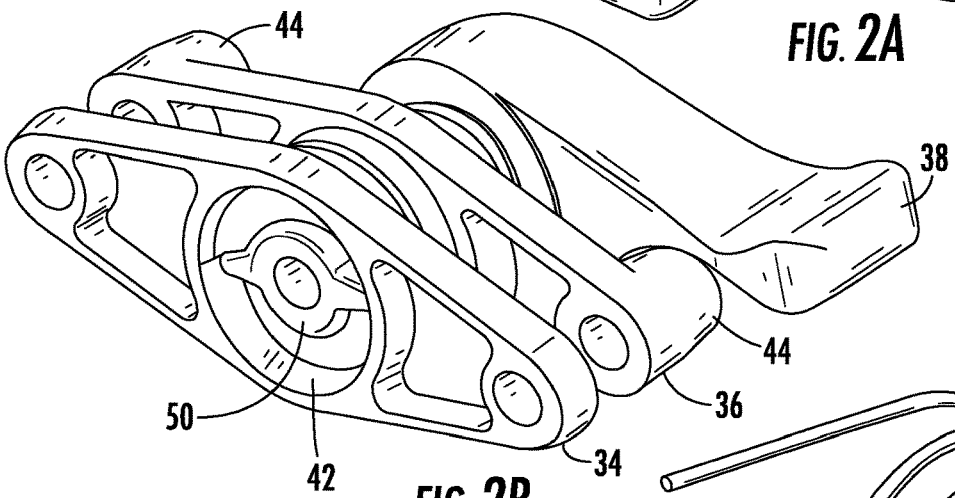
FIG. 2B is a perspective view of the injection molded embodiment of the helical cam latching device.
Figure 2C:
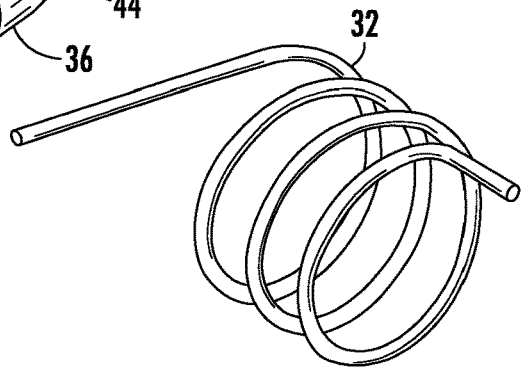
FIG. 2C is a perspective view of a loaded spring within the helical cam latching device in both axial and torsional directions.

Referring initially to FIGS. 1 and 2, a helical cam latching device 10 is shown. The helical cam latching device 10 may be formed using a variety of materials and methods. In one embodiment, the helical cam latching device 10 is a machined aluminum version. In the other embodiment, the helical cam latching device 10 is an injection molded version. The helical cam latching device 10 is structured and disposed for joining panels of a multi-panel parabolic reflector.

In accordance with one embodiment, and referring specifically to FIG. 1, the helical cam latching device 10 is formed from machined aluminum and includes a spring 12, a cam 14, a base 16, and a lever 18. The lever 18 serves as a handle for operation of the helical cam latching device 10. At opposing ends of the cam 14 there are two small through-holes 20. The base 16 includes rivets 24 at opposing ends of the base 16, each forming a positive stop for the spring-loaded lever 18 as it is actuated between the open and closed positions. The machined aluminum embodiment of the helical cam latching device 10 is a quarter turn latch such that the lever 18 can be selectively rotated back and forth ninety (90) degrees between the latched and unlatched positions. When the lever 18 is in the latched position, the spring 12 is loaded in both axial and torsional directions. The respective ranges of the axial and rotational motions are each restricted by the retainer (not shown) once it is riveted into the keyhole 22 on the cam 14. Further, the use of the spring 12 provides a zero-backlash connection that accommodates reflector panels of varying thicknesses.

Referring now to FIGS. 2A and 2B, another embodiment of the helical cam latching device 10 is formed from injection molding. The injection molding process more readily provides for an ergonomic design of the helical cam latching device 10, and includes a spring 32, a cam 34, a base 36, and a lever 38. The lever 38 serves as a handle for operation of the helical cam latching device 10. There is a through-hole 40 at opposing ends of the cam 34. Rivets 44 at opposing ends of the base 36, each extending towards the lever 38, each form a positive stop for the spring-loaded lever 38 as it is actuated between the open and closed positions. The injection molded version of the helical cam latching device 10 is also a quarter turn latch, such that the lever 38 can be selectively rotated back and forth ninety (90) degrees between the latched and unlatched positions. When the lever 38 is in the latched position, the spring 32 is loaded in both axial and torsional directions. The respective ranges of the axial and rotational motions are each restricted by the retainer 50 once it is riveted into the keyhole 42 of the cam 34. Also, the use of the spring 32 provides a zero-backlash connection that accommodates reflector panels of varying thicknesses. Still referring to FIG. 2B, the retainer 50 of the lever 38 is riveted in the keyhole 42 of the cam 34.

Figure 3A:
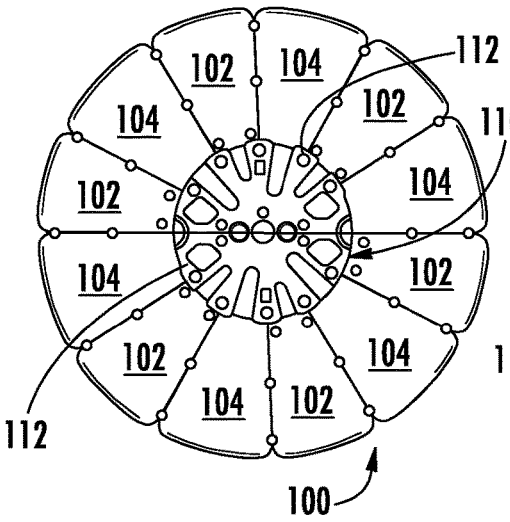
FIG. 3A is a rear elevational view of the symmetric parabolic reflector in a bi-chordal and bi-radial (BCBR) configuration.
Figure 3B:
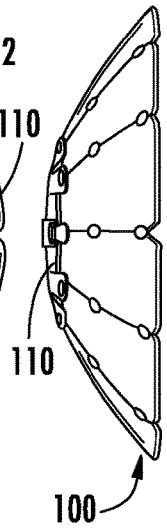
FIG. 3B is a side elevational view of the symmetric parabolic reflector in a bi-chordal and bi-radial (BCBR) configuration.
Figure 3C:
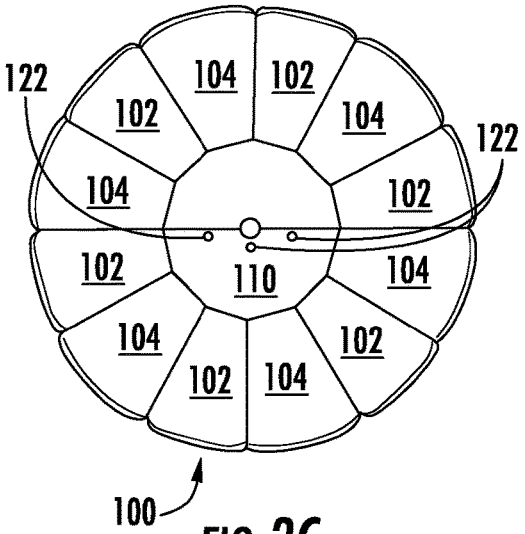
FIG. 3C is a front elevational view of a symmetric parabolic reflector in a bi-chordal and bi-radial (BCBR) configuration.

FIGS. 3A-3C illustrates a symmetric parabolic reflector 100 in a bi-chordal and bi-radial (BCBR) configuration, including a plurality of each of 28-degree and 32-degree panels 102 and 104. In one embodiment, the symmetric parabolic reflector 100 includes six (6) 28-degree reflector panels 102 and six (6) 32-degree reflector panels 104. As indicated, the central angle of the arc of each 28-degree reflector panel 102 is 28°, while the central angle of the arc of each 32-degree reflector panel 104 is 32°. The 28-degree reflector panels 102 and 32-degree reflector panels 104 are joined together in an alternating arrangement to form the symmetric parabolic reflector 100 and each reflector panel is mounted on a reflector hub 110 which resides internal of the symmetric parabolic reflector 100.

Referring to FIG. 3A, the front elevational view shows the geometry of the reflector hub 110 and the symmetric parabolic reflector 100 are two concentric circles. The reflector hub 110 is made of two semi-circle pieces 112 associated with each other. The assembled symmetric parabolic reflector 100 includes the reflector panels, i.e. the 28-degree reflector panels 102 and 32-degree reflector panels 104, secured to the perimeter of the reflector hub 110. The connection between one 28-degree reflector panel 102 and one 32-degree reflector panel 104 is secured by two helical cam latching devices 10. Each reflector panel 102 and 104 is mounted on the reflector hub 110 via two helical cam latching devices 10. The difference in the central angels of the 28-degree reflector panels 102 and 32-degree reflector panels 104 is featured as bi-chordal.

Referring to FIG. 3B, the assembled symmetric parabolic reflector 100 is shown mounted on the reflector hub 110. Referring to FIG. 3C, the length in the radial direction of the 28-degree reflector panel 102 is 28 inches, while the length in the radial direction of the 32-degree reflector panel 104 is 29 inches. The difference in the radial lengths of the reflector panels, i.e. the 28-degree reflector panels 102 and the 32-degree reflector panels 104, is featured as bi-radial. This bi-chordal and bi-radial (BCBR) configuration of the symmetric parabolic reflector 100 provides sufficient room for the helical cam latching devices 10 to join the 28-degree reflector panels 102 and the 32-degree reflector panels 104. In addition, the differences in the sizes of the reflector panels, i.e. the central angles of the arc and the radial lengths, proves suitable for high packability wherein the 28-degree reflector panels 102 may be nested inside the 32-degree reflector panels 104.

Figure 4:
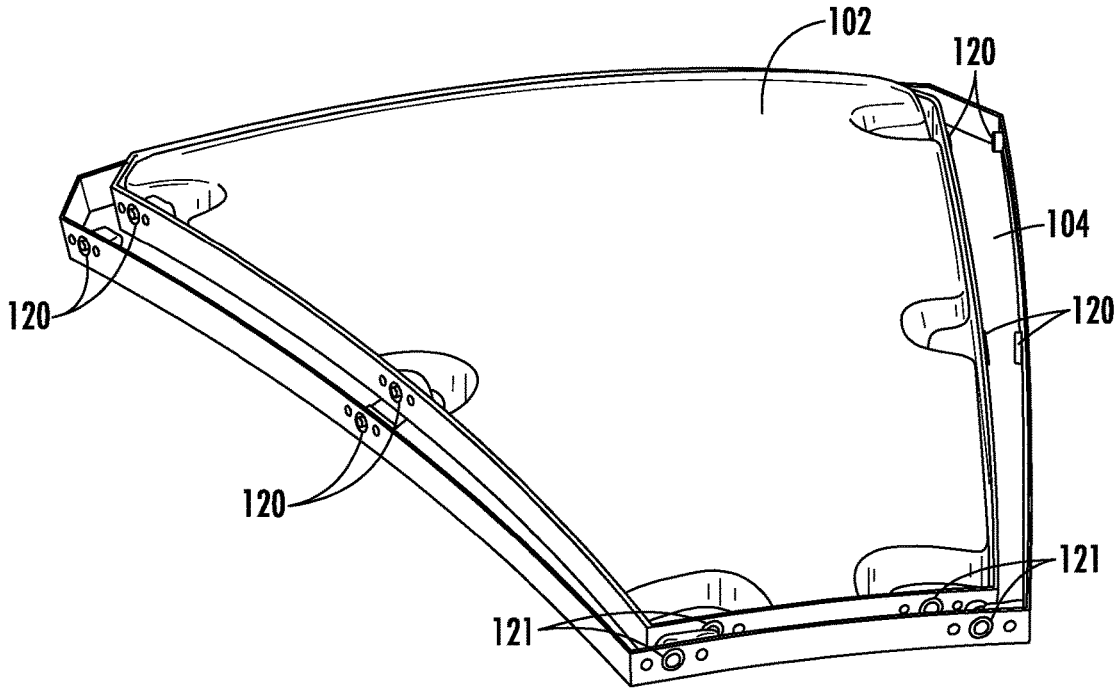
FIG. 4 illustrates a 28-degree reflector panel nested inside a 32-degree reflector panel.

FIG. 4 illustrates the 28-degree reflector panel 102 nested inside the 32-degree reflector panel 104. There are two recessed pockets on each side edge of each reflector panel 102, providing access to attachment points 120. In one embodiment, the recessed pockets are semi-circle pockets. When two adjacent reflector panels 102 and 104 are joined together, the attachment points 120 on the respective reflector panels 102 and 104 are in alignment with each other. The helical cam latching devices 10 are then used to secure two adjacent reflector panels 102 and 104 together. When reflector panels 102 and 104 and the reflector hub 110 are put together, two attachment points 121 on each of the reflector panels 102 and 104 are configured for the helical cam latching devices 10 to mount the reflector panels 102 and 104 on the reflector hub 110. There are two additional recessed pockets at both corners of the inner arc of each reflector panel 102 surrounding the corresponding attachment point 121. In one embodiment, these recessed pockets are also semi-circle pockets. Due to the different sizes of the 28-degree reflector panel 102 and the 32-degree reflector panel 104 in both chordal and radial directions, the 28-degree reflector panel 102 can be entirely nested inside the 32-degree reflector panel 104.

Figure 5:
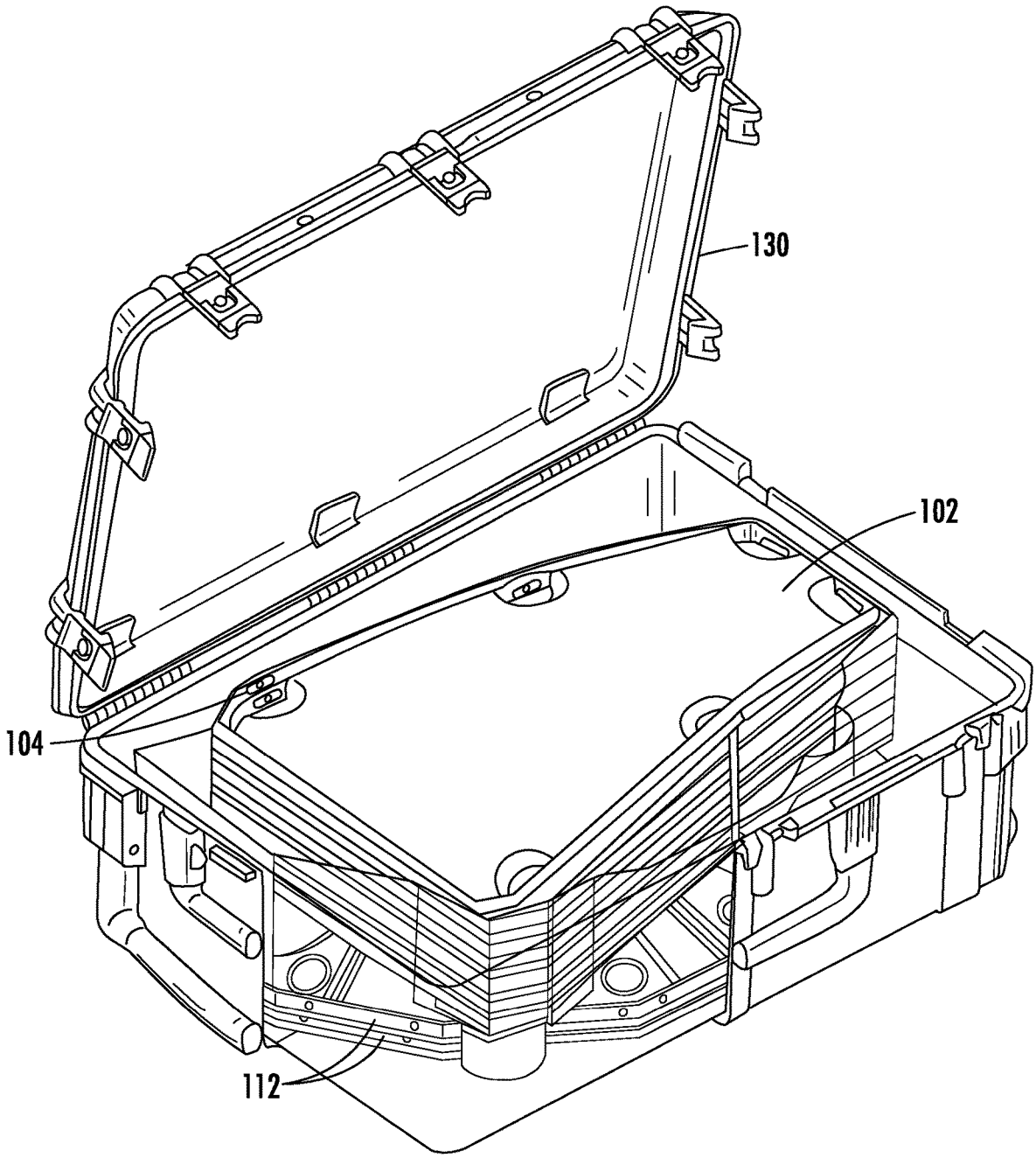
FIG. 5 illustrates a transit case for the nested reflector panels in a vertical stack.

Referring to FIG. 5, multiple pairings of nested reflector panels 102 and 104 form a well-defined vertical stack that fits efficiently and effectively in a transit case 130. In one embodiment, all reflector panels 102 and 104, two pieces of the reflector hub 110, and all required helical cam latching devices 10 are stored in the transit case 130.

Figure 6A:
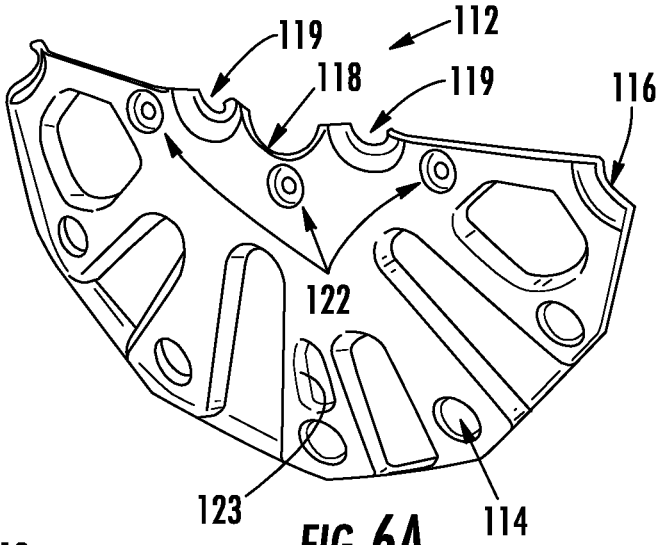
FIG. 6A illustrates a perspective view of a semi-circle piece of the reflector hub.
Figure 6B:
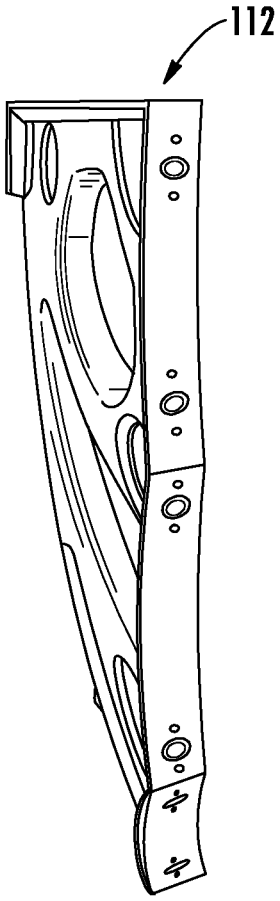
FIG. 6B illustrates a top plan view of a semi-circle piece of the reflector hub.
Figure 6C:
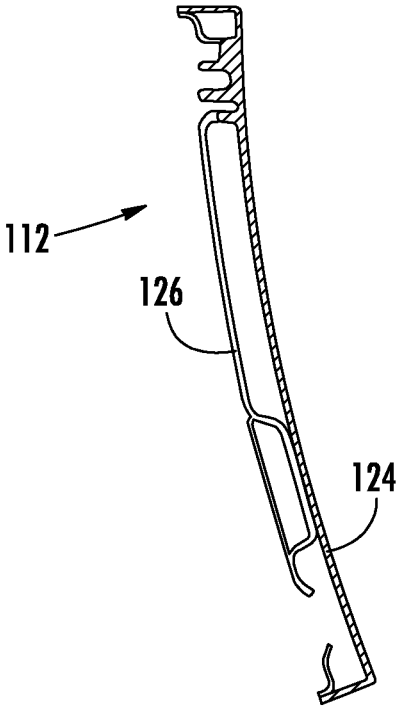
FIG. 6C illustrates a cross-sectional view of a semi-circle piece of the reflector hub.

FIG. 6A-6C illustrate a semi-circle piece 112 which forms a portion of the reflector hub 110. As previously stated, the reflector hub 110 is formed from two semi-circle pieces 112, and the combined contour of the outer perimeter of the assembled reflector hub 110 fits the inner arc of the ring of the reflector panels 102 and 104. The semi-circle piece 112 is a hollowed carbon fiber thin-walled lightweight structure with a contoured parabolic carbon fiber reflector back structure (see below) for providing sufficient bending and torsional stiffness for operation of the reflector hub 110 in windy conditions.

Referring to FIG. 6A, the semi-circle piece 112 includes five circled recessed pockets 114 along its outer contour allowing for latch access and providing local wall reinforcement to resist loading from the mounted reflector panels 102 and 104. Two recessed semi-circular pockets 116 are located on both ends of the outer contour of the semi-circle piece 112. Along the flat end of the semi-circle piece 112, there is a recessed pocket 118 in the middle and two smaller pockets 119 on opposing sides of the recessed pocket 118. When two semi-circle pieces 112 are put together, recessed pockets are formed for the helical cam latching device 10 to bond the two semi-circle pieces 112, thereby forming the reflector hub 110. There are three additional recessed pockets 122 for assisting in mounting of the symmetric parabolic reflector 100 to the foldable positioner 300. An aluminum insert 123 provides a connection point for an elevation jack (see below) as well as a pocket for low profile storage of a spherical rod end joint.

Referring to FIGS. 6B and 6C, the top view of the semi-circle piece 112 and a cross-sectional view indicate its size, shape and the bonding structures for mounting the reflector panels 102 and 104 on the reflector hub 110. Integral hard points provide a precision mounting surface for accurately aligning the back side of the symmetric parabolic reflector 100 relative to the vertex of the parabola and ties together structurally the front skin 124 and the embossed carbon fiber back skin 126, which stiffens the overall carbon fiber structure.

Figure 7:
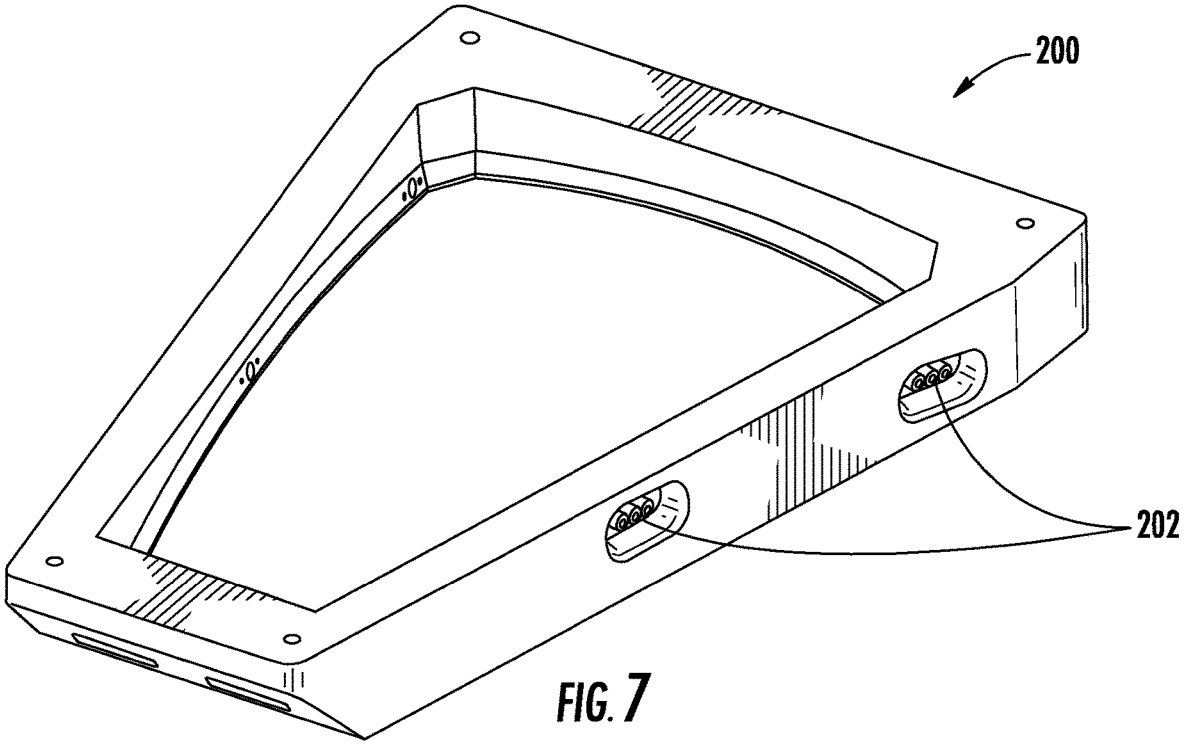
FIG. 7 is a carbon fiber layup tool for forming the reflector panels with highly repeatable mounting features.

FIG. 7 illustrates a carbon fiber layup tool 200 for forming the reflector panels 102 and 104 with highly repeatable mounting features on the sidewall regions of the reflector panels 102 and 104. In one embodiment, the carbon fiber layup tool 200 is a case enclosing a space in the shape of the reflector panel 102. In another embodiment, the carbon fiber layup tool 200 is a case enclosing a space in the shape of the reflector panel 104. Along each side of the carbon fiber layup tool 200, there are two recessed slots each containing three molding inserts 202. The manufacturing of the reflector panels 102 and 104 is a vacuum infusion process. The carbon fiber layup tool 200 provides retractable features that allow the key mounting feature to be molded into the infused carbon fiber structure and then easily retracted to allow part ejection from the carbon fiber layup tool 200. The retractable features are sealed for use with the vacuum infusion process and have a positive stop position to ensure position repeatability of the inserts that assure feature repeatability.

Figure 8:
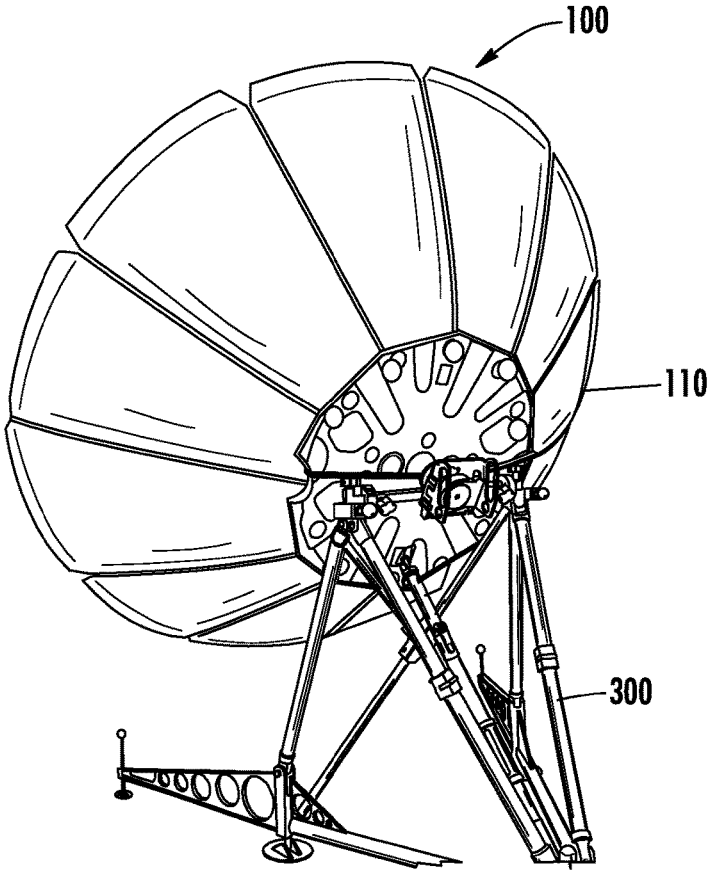
FIG. 8 is a rear perspective view of an assembled symmetric parabolic reflector in accordance with an embodiment.
Figure 9:
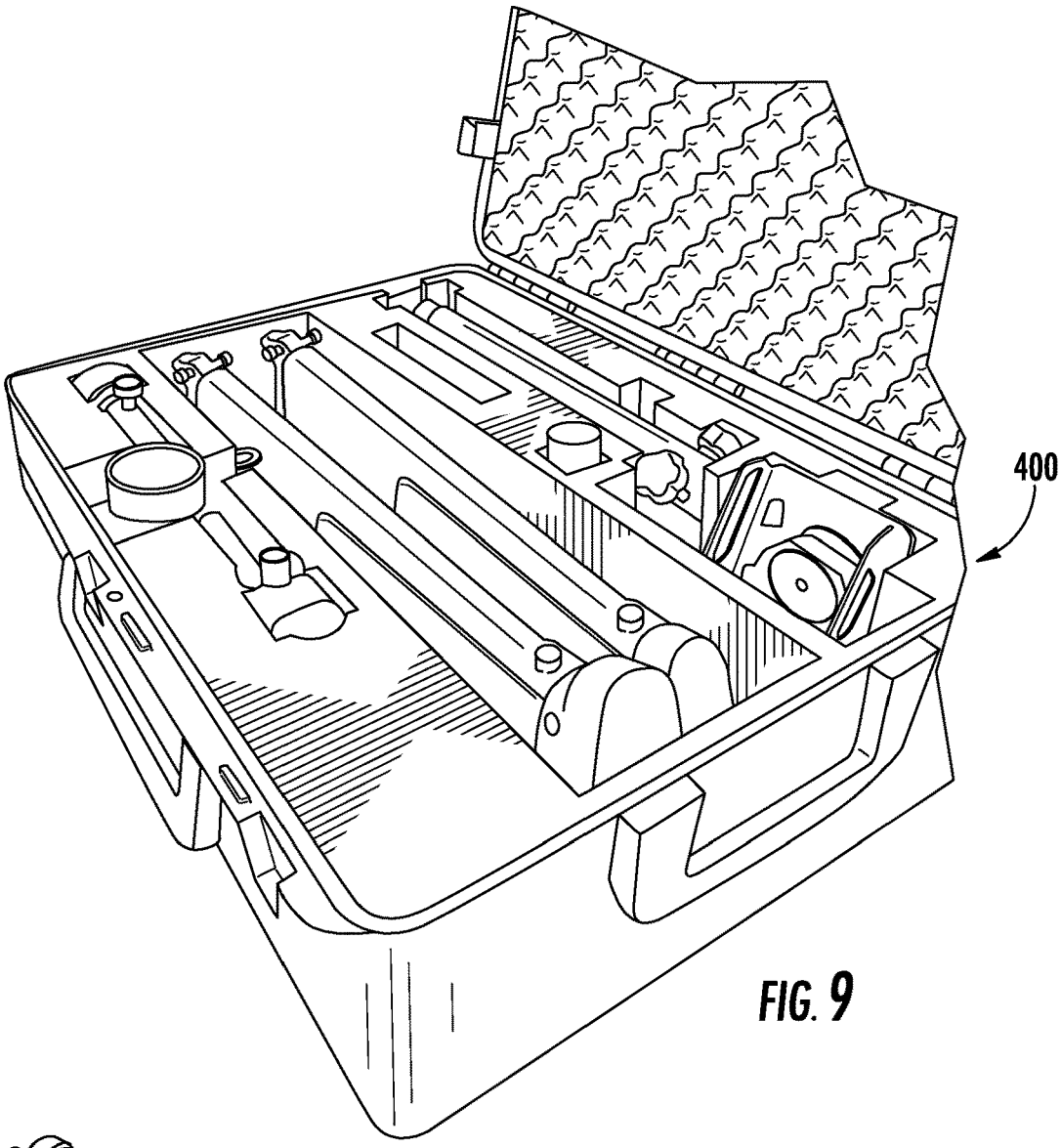
FIG. 9 is a transportation case accommodating the packed positioner.

FIG. 8 illustrates an assembled symmetric parabolic reflector 100 supported by a foldable positioner 300. The foldable positioner 300 is sturdy enough for the 2.0M antenna to operate in gusting winds. The elevation and azimuth adjustments of the foldable positioner 300 ensure the position and the orientation of the antenna for geostationary satellite acquisition and peaking. The foldable positioner 300 has a stable base that provides for leveling and serves as an anchor to avoid tipping over. Referring to FIG. 9, the foldable positioner 300 is highly packable into a relatively small transportation case 400 for storage and transportation thereof.

Figure 10:
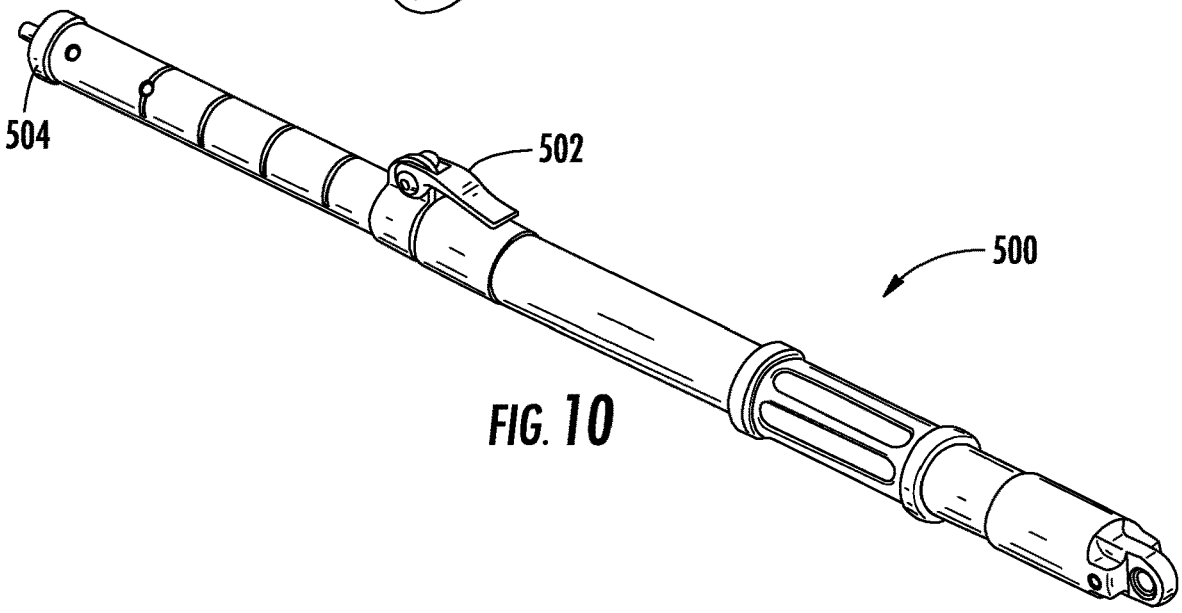
FIG. 10 is a telescoping actuator for adjustment in elevation.

FIG. 10 illustrates a telescoping manual actuator 500 for elevation adjustment. The telescoping manual actuator 500 is a lightweight stiff rod with ergonomic design. The movement of the telescoping actuator 500 is smooth enough for both coarse and fine adjustments in elevation for pointing and peaking the symmetric parabolic reflector 100 for geostationary satellite acquisition. An integral gas spring is incorporated to provide positive thrust in the telescoping actuator 500 to aid positioning in low look elevation positions. The telescoping actuator 500 includes a quick release mechanism 502 structured and disposed to permit the rod end 504 to be selectively disconnected from the reflector 100 for easy storage of the telescoping actuator 500.

Figure 11:
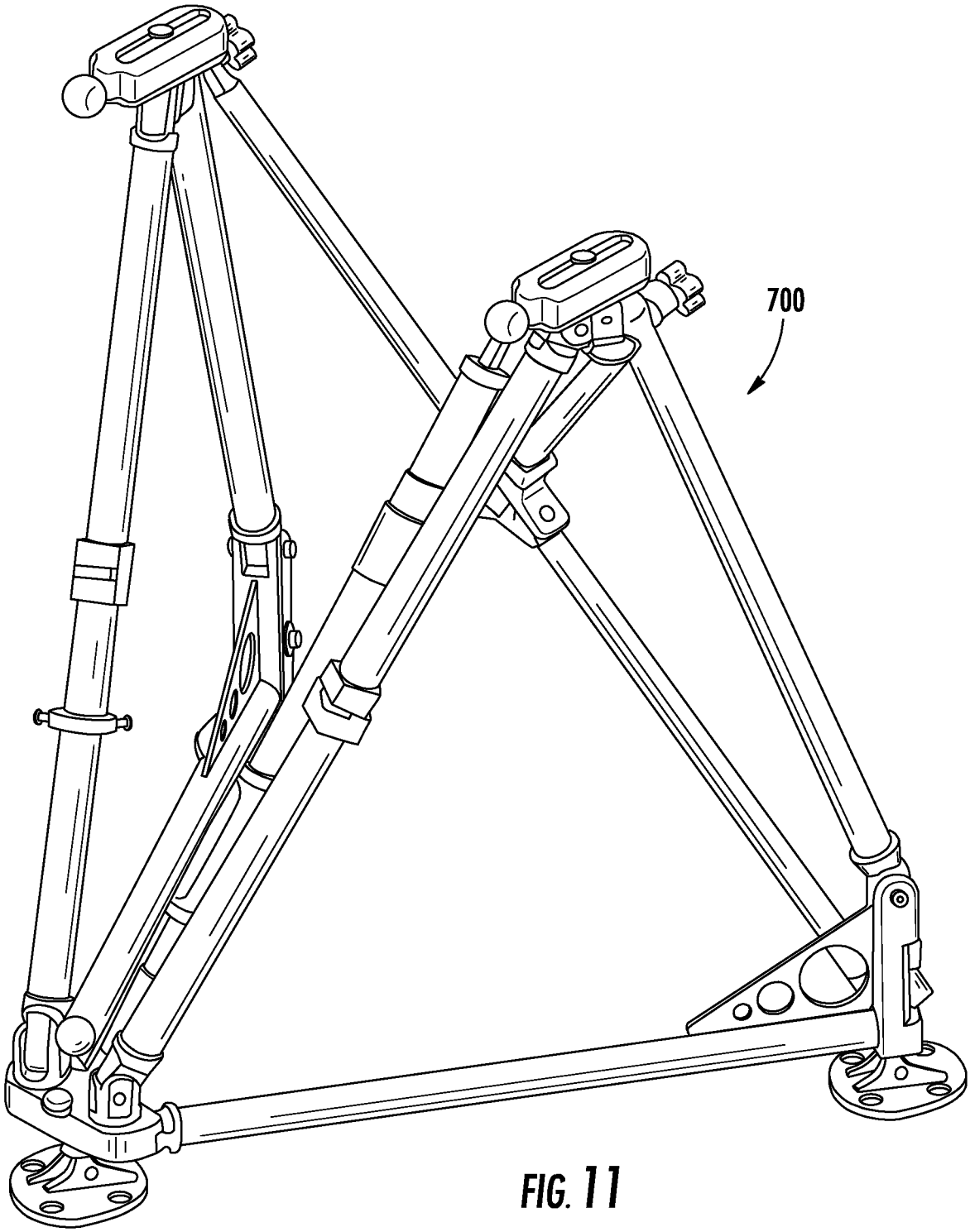
FIG. 11 illustrates a prior art design of a positioner without high-efficient packability.
Figure 12:
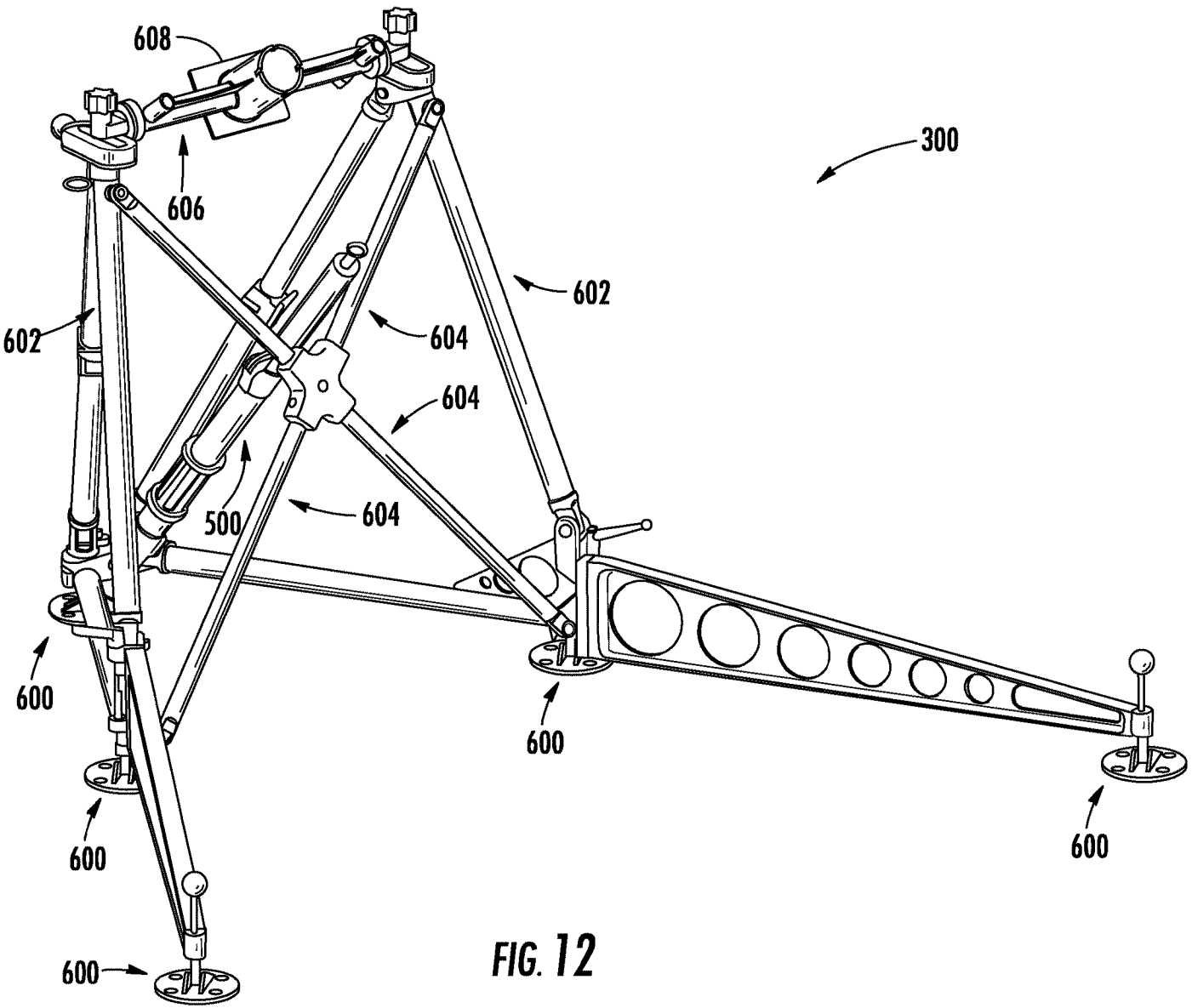
FIG. 12 illustrates a bearing-free azimuth adjustment mechanism of the foldable positioner.

Referring to FIG. 11, the traditional design of an antenna positioner 700 is generally bulky and not highly packable, thereby making transportation of the antenna positioner 700 relatively difficult. FIG. 12 illustrates the foldable positioner 300 with a bearing-free azimuth adjustment mechanism. The foldable positioner 300 includes upright tubes 602 extending from corresponding height-adjustable sand feet 600. A first end of the telescoping actuator 500 is pivotally connected to one of the height-adjustable sand feet 600 and the opposing rod end 504 of the telescoping actuator 500 connects to the hub 100 at the aluminum insert 123. The elevation-azimuth bar 606 is supported by the upright tubes 602 at opposing ends such that no bearing is used to obtain azimuth rotation. An RF package receiver plate 608 of the elevation-azimuth bar 606 is centrally secured to the reflector hub 110. The vertical motion of the elevation-azimuth bar 606 changes the angle between the upright tubes 602 of the foldable positioner 300. In such an arrangement, the telescoping actuator 500 does not have an axis of rotation, i.e. bearing-free, for geostationary acquisition. The bearing-free mechanism significantly reduces the load on the overall structure of the foldable positioner 300. Thus, the foldable positioner 300 can be designed at lower cost and lighter weight for high packability. The smooth motion of the elevation-azimuth bar 606 generates small angle changes of the upright tubes 602 of the foldable positioner 300, providing fine azimuth adjustment. The fine azimuth adjustment is up to a 20-degree azimuth adjustment by a 10-degree angular movement on both ends of the elevation axis weldment. The foldable positioner 300 also has braking and locking mechanisms to maintain the retention of its position under loads. Moreover, the components of the low-cost, lightweight, highly packable foldable positioner 300 can be selectively packed into a relatively small transportation case 400 (see FIG. 9).

Referring now to FIGS. 13-17, an embodiment is shown wherein space frame antenna 800 is based on 2.2M offset optics and includes panels 802 and reflector hub 810, which collectively form reflector 804, and positioner 806.

Figure 14:
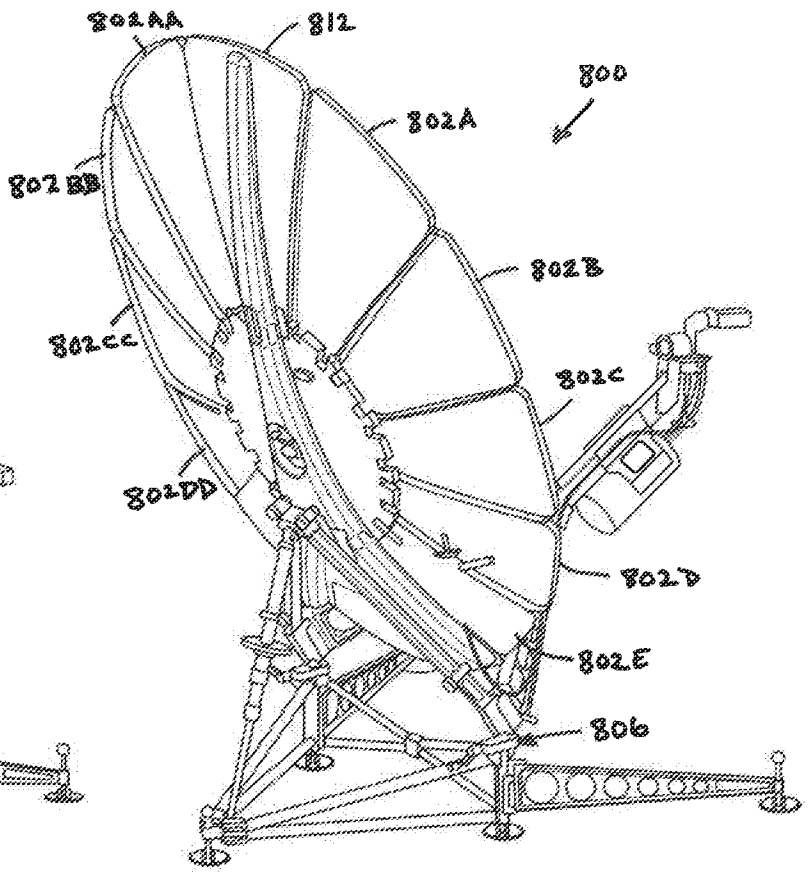
FIG. 14 is a rear perspective view of the assembled 2.2M offset antenna of FIG. 13.
Figure 13:
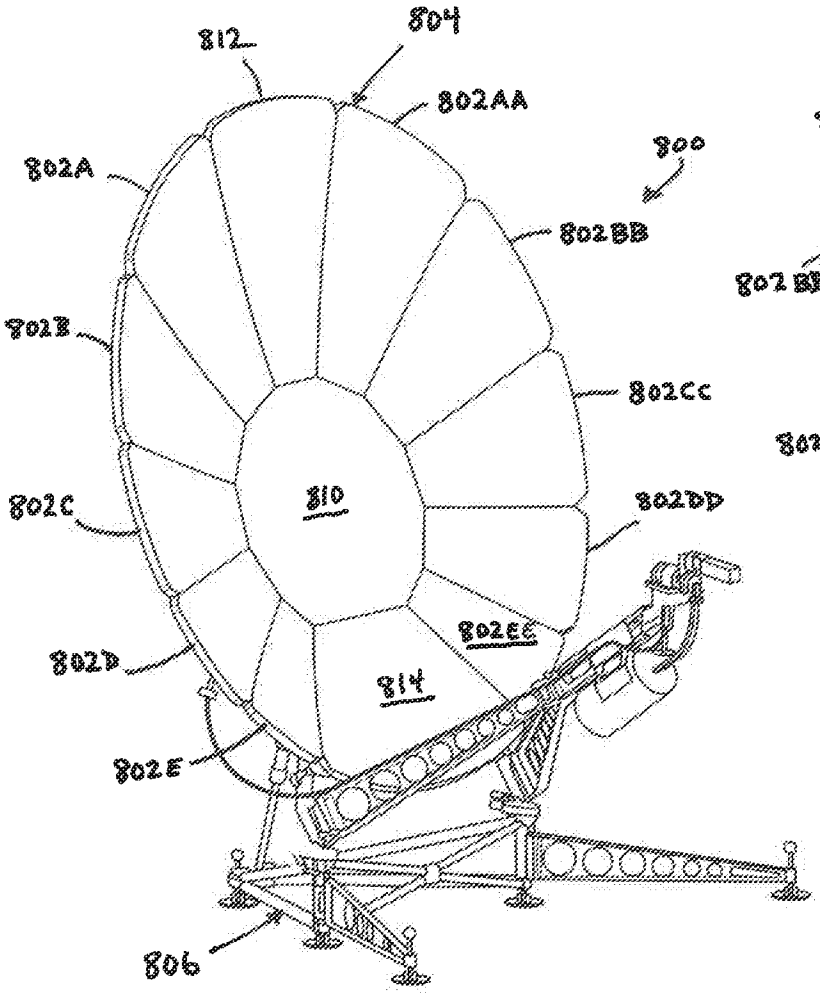
FIG. 13 is a front perspective view of an assembled 2.2M offset antenna in accordance with an embodiment.
Figure 15:
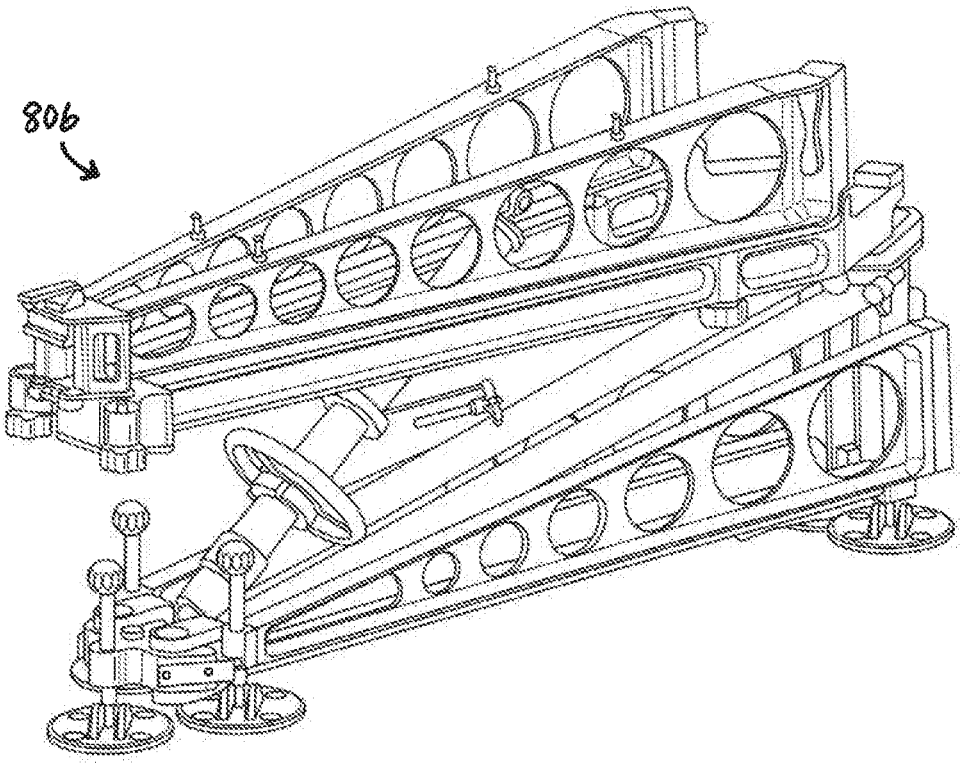
FIG. 15 illustrates the 2.2M positioner in a stowed configuration.
Figure 17:
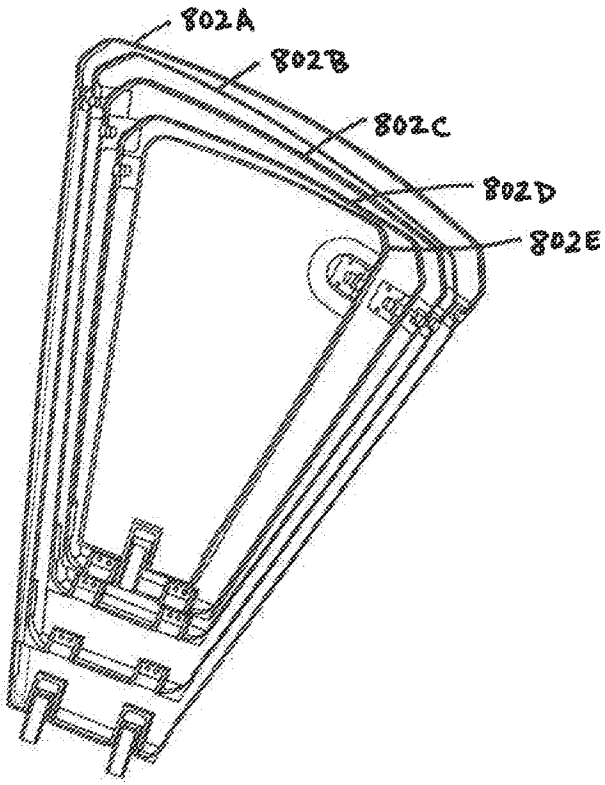
FIG. 17 illustrates disassembled side panels of the 2.2M reflector in a nested configuration.
Figure 16:
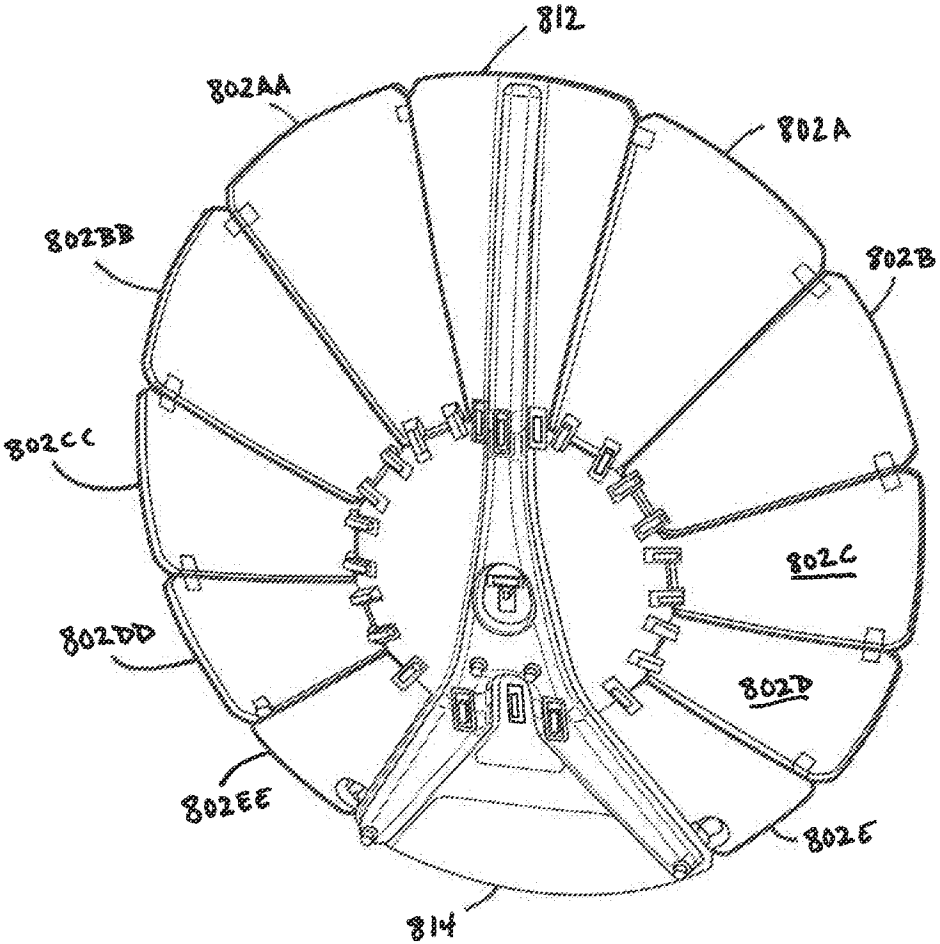
FIG. 16 is an isolated rear perspective view of an assembled 2.2M reflector.

The antenna 800 is structured and disposed for maximizing operation and portability. FIGS. 13 and 14 show antenna 800 in an operative configuration. Referring specifically to FIG. 15, the positioner 806 is structured and disposed to be selectively folded into a stowed configuration.

The panels 802 are sized progressively (i.e., sequentially) smaller and configured to be nested together in a stacked configuration when not in use. In an embodiment, as shown throughout FIGS. 13-17 and particularly illustrated in FIGS. 16 and 17, side panels 802 include side panels 802A, 802B, 802C, 802D and 802E, each being uniquely sized relative to each other, such as being progressively smaller, and sized and configured to be nested together in a stacked configuration when separated from reflector hub 810, and side panels 802AA, 802BB, 802CC, 802DD and 802EE, each uniquely sized relative to each other, such as being progressively smaller, and sized and configured to be nested together in a stacked configuration when separated from reflector hub 810. In this embodiment, there are two sets of side panels 802A-E and 802AA-EE which may be selectively nested together for storage and transport. Central panels 812 and 814 may be selectively separated from reflector hub 810 for storage and transport. In an embodiment, one or both central panels 812 and 814 may be nested together with one or both of nested side panels 802A-E and 802AA-EE. The side panels 802A-E and 802AA-EE may be stored in a transit case 130 when nested.

One or more of the side panels 802A-E and 802AA-EE, reflector hub 810, and central panels 812 and 814 may be secured together during operation of the antenna 800 using latches or other attachment means. In one embodiment, the helical cam latching device 10 is used for joining the panels.

Unless otherwise defined, all terms (including technical and scientific terms) used herein have the same meaning as commonly understood by one of ordinary skill in the art to which this subject matter belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. For brevity and/or clarity, well-known functions or constructions may not be described in detail herein.

The term "exemplary" is used herein to mean serving as an example, instance, or illustration. Any aspect or design described herein as "exemplary" is not necessarily to be construed as preferred or advantageous over other aspects or designs. Similarly, examples are provided herein solely for purposes of clarity and understanding and are not meant to limit the subject innovation or portion thereof in any manner.

The terms "for example" and "such as" mean "by way of example and not of limitation." The subject matter described herein is provided by way of illustration for the purposes of teaching, suggesting, and describing, and not limiting or restricting. Combinations and alternatives to the illustrated embodiments are contemplated, described herein, and set forth in the claims.

For convenience of discussion herein, when there is more than one of a component, that component may be referred to herein either collectively or singularly by the singular reference numeral unless expressly stated otherwise or the context clearly indicates otherwise. For example, components 38 (plural) or component 38 (singular) may be used unless a specific component is intended. Also, the singular forms "a," "an," and "the" are intended to include the plural forms as well, unless expressly stated otherwise or the context indicates otherwise.

It will be further understood that the terms "includes," "comprises," "including," and/or "comprising" specify the presence of stated features, steps, operations, elements, and/or components, but do not preclude the presence or addition of one or more other features, steps, operations, elements, components, and/or groups thereof unless explicitly stated otherwise or the context clearly requires otherwise. The terms "includes," "has" or "having" or variations in form thereof are intended to be inclusive in a manner similar to the term "comprises" as that term is interpreted when employed as a transitional word in a claim.

It will be understood that when a component is referred to as being "connected" or "coupled" to another component, it can be directly connected or coupled or coupled by one or more intervening components unless expressly stated otherwise or the context clearly indicates otherwise.

The term "and/or" includes any and all combinations of one or more of the associated listed items. As used herein, phrases such as "between X and Y" and "between about X and Y" should be interpreted to include X and Y unless expressly stated otherwise or the context clearly indicates otherwise.

Terms such as "about", "approximately", and "substantially" are relative terms and indicate that, although two values may not be identical, their difference is such that the apparatus or method still provides the indicated or desired result, or that the operation of a device or method is not adversely affected to the point where it cannot perform its intended purpose. As an example, and not as a limitation, if a height of "approximately X inches" is recited, a lower or higher height is still "approximately X inches" if the desired function can still be performed or the desired result can still be achieved.

While the terms vertical, horizontal, upper, lower, bottom, top and the like may be used herein, it is to be understood that these terms are used for ease in referencing the drawing and, unless otherwise indicated or required by context, does not denote a required orientation.

The different advantages and benefits disclosed and/or provided by the implementation(s) disclosed herein may be used individually or in combination with one, some or possibly even all of the other benefits. Furthermore, not every implementation, nor every component of an implementation, is necessarily required to obtain, or necessarily required to provide, one or more of the advantages and benefits of the implementation.

Conditional language, such as, among others, "can", "could", "might", or "may", unless specifically stated otherwise, or otherwise understood within the context as used, is generally intended to convey that certain embodiments preferably or optionally include certain features, elements and/or steps, while some other embodiments optionally do not include those certain features, elements and/or steps. Thus, such conditional language indicates, in general, that those features, elements and/or step may not be required for every implementation or embodiment.

Those skilled in the art will recognize many modifications may be made to the implementation(s) disclosed herein without departing from the scope or spirit of the claimed subject matter. The subject matter described above is provided by way of illustration only and should not be construed as limiting. Furthermore, the claimed subject matter is not limited to implementations that solve any or all disadvantages noted in any part of this disclosure. Various modifications and changes may be made to the subject matter described herein without following the exemplary embodiments and applications illustrated and described, and without departing from the spirit and scope of the following claims.

What has been described above includes examples of aspects of the claimed subject matter. It is, of course, not possible to describe every conceivable combination of components or methodologies for purposes of describing the claimed subject matter, but one of ordinary skill in the art may recognize that many further combinations and permutations of the disclosed subject matter are possible. Accordingly, the disclosed subject matter is intended to embrace all such alterations, modifications and variations that fall within the spirit and scope of the appended claims.

Although the subject matter presented herein has been described in language specific to components used therein, it is to be understood that the appended claims are not necessarily limited to the specific component or characteristic thereof described herein. Rather, the specific components and characteristics thereof are disclosed as example forms of implementing the claims.

What is claimed is:

1. A-antenna comprising:

a reflector hub;

a positioner that is sized and configured for supporting the reflector hub;

a plurality of first panels, each first panel having a first radial dimension and a first chordal dimension;

a plurality of second panels, each second panel having a second radial dimension and a second chordal dimension, the second radial dimension being smaller than the first radial dimension, the second chordal dimension being smaller than the first chordal dimension, wherein a second panel is of a size to fit inside a first panel;

wherein, when the antenna is in an operative configuration, the first panels and the second panels are secured to the reflector hub, the first panels and the second panels being in an alternating arrangement; and wherein, when the antenna is in a stowed configuration, the first panels and the second panels are separated from the reflector hub, the second panels are nested inside the first panels, and the first panels are in a stacked arrangement.

2. The antenna as recited in claim 1 further comprising an upper central panel that is selectively securable to the reflector hub.

3. The antenna as recited in claim 1 further comprising a lower central panel that is selectively securable to the reflector hub.

4. The antenna as recited in claim 1 wherein the plurality of first panels comprises five panels.

5. The antenna as recited in claim 1 wherein the plurality of second panels comprises five panels.

6. The antenna as recited in claim 1 wherein the positioner is foldable.

7. An apparatus comprising:

a reflector hub;

a positioner that is sized and configured for supporting the reflector hub;

a plurality of reflector panels including a first plurality of panels and a second plurality of panels, the first plurality of panels and the second plurality of panels each being selectively securable to the reflector hub;

a first panel of the first plurality of panels having a first radial dimension and a first chordal dimension, other panels of the first plurality of panels having successively smaller radial dimensions and successively smaller chordal dimensions, such that the first plurality of panels may be at least partially nested together in a stacked configuration when separated from the reflector hub; and a first panel of the second plurality of panels having a second radial dimension and a second chordal dimension, other panels of the second plurality of panels having successively smaller radial dimensions and successively smaller chordal dimensions, wherein the second radial dimension may be either the same as, or different from, the first radial dimension, and wherein the second chordal dimension may be either the same as, or different from, the first chordal dimension, such that the second plurality of side panels may be at least partially nested together in a stacked configuration when separated from the reflector hub.

8. The apparatus as recited in claim 7 further comprising an upper central panel that is selectively securable to the reflector hub.

9. The apparatus as recited in claim 7 further comprising a lower central panel that is selectively securable to the reflector hub.

10. The apparatus as recited in claim 7 wherein the first plurality of panels comprises five panels.

11. The apparatus as recited in claim 7 wherein the second plurality of panels comprises five panel.

12. The apparatus as recited in claim 7 wherein the positioner is foldable.

13. An apparatus comprising:

a reflector hub;

a positioner that is sized and configured for supporting the reflector hub;

a plurality of reflector panels including a first plurality of panels and a second plurality of panels, the first plurality of panels and the second plurality of panels each being selectively securable to the reflector hub;

each panel of the first plurality of panels having a first dimension progressively smaller relative to the other panels of the first plurality of panels such that the first plurality of panels may be nested together in a stacked configuration when separated from reflector hub; and each panel of the second plurality of panels having a second dimension progressively smaller relative to the other panels of the second plurality of panels such that the second plurality of panels may be nested together in a stacked configuration when separated from reflector hub;

wherein, when the apparatus is in a operative configuration, the panels of the first plurality of panels and the panels of the second plurality of panels are secured to the reflector hub, the panels of the first plurality of panels being arranged in a descending order by the first dimension and the panels of the second plurality of panels being arranged in a descending order by the second dimension, and wherein, when the apparatus is in a stowed configuration, the panels of the first plurality of panels and the panels of the second plurality of panels are separated from the reflector hub, the panels of the first plurality of panels being nested in a descending order by the first dimension, and the panels of the second plurality of panels being nested in a descending order by the second dimension.

14. The apparatus as recited in claim 13 further comprising an upper central panel that is selectively securable to the reflector hub.

15. The apparatus as recited in claim 13 further comprising a lower central panel that is selectively securable to the reflector hub.

16. The apparatus as recited in claim 13 wherein the first plurality of panels comprises five panels.

17. The apparatus as recited in claim 13 wherein the second plurality of panels comprises five panels.

18. The apparatus as recited in claim 13 wherein the positioner is foldable.

19. The apparatus as recited in claim 7 wherein the second radial dimension is the same as the first radial dimension.

20. The apparatus as recited in claim 7 wherein the second chordal dimension is the same as the first chordal dimension.

* * * * *